US011913670B2

(12) United States Patent
Mao et al.

(10) Patent No.: US 11,913,670 B2
(45) Date of Patent: Feb. 27, 2024

(54) SEALED BOX CONTAINER, MAIN MACHINE OF HEAT RECOVERY SWITCHING DEVICE, AND REFRIGERATION DEVICE

(71) Applicants: GD MIDEA HEATING & VENTILATING EQUIPMENT CO., LTD., Foshan (CN); MIDEA GROUP CO., LTD., Foshan (CN)

(72) Inventors: Huajun Mao, Foshan (CN); Shuqing Liu, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 14 days.

(21) Appl. No.: 17/764,981

(22) PCT Filed: Mar. 18, 2020

(86) PCT No.: PCT/CN2020/080062

§ 371 (c)(1),
(2) Date: Mar. 30, 2022

(87) PCT Pub. No.: WO2021/098102

PCT Pub. Date: May 27, 2021

(65) Prior Publication Data

US 2023/0027551 A1 Jan. 26, 2023

(30) Foreign Application Priority Data

Nov. 19, 2019 (CN) ..... 201922003797.1

(51) Int. Cl.
*F24F 13/22* (2006.01)
*F24D 3/10* (2006.01)
(Continued)

(52) U.S. Cl.
CPC ..... *F24F 13/22* (2013.01); *F24D 3/1058* (2013.01); *F24F 1/26* (2013.01); *F24F 1/34* (2013.01)

(58) Field of Classification Search
CPC ..... F24F 13/22; F24F 1/26; F24F 1/34; F24F 1/32; F24D 3/1058; F25B 41/42
See application file for complete search history.

(56) References Cited

U.S. PATENT DOCUMENTS

2009/0049855 A1* 2/2009 Murata ..... F24F 1/34 29/890.03

FOREIGN PATENT DOCUMENTS

CN 203375091 U 1/2014
CN 206412095 U 8/2017
(Continued)

OTHER PUBLICATIONS

Search Report dated Oct. 17, 2022 for EP application 20890526.5.
ISR for PCT application PCT/CN2020/080062.

*Primary Examiner* — Frantz F Jules
*Assistant Examiner* — Martha Tadesse

(57) ABSTRACT

Disclosed are a sealed box container, a main machine of a heat recovery switching device and a refrigeration device. The sealed box container includes box bodies that are spliced to form a sealed cavity, and is provided with a through hole in communication with the sealed cavity, and the sealed cavity is used for accommodating a pipeline assembly of a main machine, and the pipeline assembly is connected to an external pipeline by means of the through hole.

12 Claims, 14 Drawing Sheets

(51) Int. Cl.
*F24F 1/26* (2011.01)
*F24F 1/34* (2011.01)

(56) References Cited

FOREIGN PATENT DOCUMENTS

| | | | | | |
|---|---|---|---|---|---|
| CN | 107640449 | A | | 1/2018 | |
| CN | 108826517 | A | * | 11/2018 | |
| CN | 208603046 | U | | 3/2019 | |
| CN | 209388709 | U | | 9/2019 | |
| EP | 1876398 | A1 | | 1/2008 | |
| EP | 2402666 | A2 | | 1/2012 | |
| EP | 2921792 | A1 | * | 9/2015 | ..... F16L 5/10 |
| EP | 2921792 | A1 | | 9/2015 | |
| JP | 2014025668 | A | * | 2/2014 | |
| JP | 2014025668 | A | | 2/2014 | |

* cited by examiner

SEALED BOX CONTAINER, MAIN MACHINE OF HEAT RECOVERY SWITCHING DEVICE, AND REFRIGERATION DEVICE

CROSS-REFERENCES TO RELATED APPLICATIONS

The present disclosure is a national phase application of International Application No. PCT/CN2020/080062, filed on Mar. 18, 2020, which claims priority to Chinese Patent Application Serial No. 201922003797.1, filed on Nov. 19, 2019, the entireties of which are herein incorporated by reference.

FIELD

The present application relates to the field of refrigeration devices, and more particularly, to a sealed box container, a main machine including the above sealed box container, and a refrigeration device including the heat recovery switching device.

BACKGROUND

Existing heat recovery switching devices employ a separate water tray to collect the condensed water, and adheres a sponge inside a machine body to reduce condensation. The added water tray and the sponge increase a thickness of the machine body, and lead to low assembly efficiency. Meanwhile, a drain pipe needs to be added at the client end, and a drainage system needs to be designed separately, resulting in increased installation costs and reduced installation efficiency. In one embodiment, the condensed water also reduces heat recovery efficiency, and is not conducive to requirements for energy saving and environmental protection.

SUMMARY

In order to solve at least one of the above problems, embodiments of the present application are to provide a sealed box container.

Another embodiment of the present application is to provide a main machine including the above sealed box container.

Yet another embodiment of the present application is to provide a refrigeration device including the above main machine for a heat recovery switching device.

Embodiments of the present application provide a sealed box container, and the sealed box container is adapted to be arranged in a main machine for a heat recovery switching device. The sealed box container includes: box bodies spliced to define a sealed cavity and provided with a through hole in communication with the sealed cavity. The sealed cavity is configured to accommodate a pipeline assembly of the main machine, and the pipeline assembly is coupled to an external pipeline via the through hole.

The sealed box container provided by the embodiments of the first aspect of the present application includes box bodies, box bodies can be spliced to define a sealed cavity, and when the sealed box container is assembled in the main machine, the pipeline assembly of the main machine can be accommodated in the sealed cavity, to block free exchange of the air inside the main machine with the outside air. Thus, generation of condensation can be effectively prevented, and generation of condensed water in the main machine can be avoided. This is conducive to improvement of heat recovery efficiency and conforms to requirements for energy saving and environmental protection. Furthermore, a water tray and an added sponge in a main machine of the related art can be omitted, and this is conducive to reduction in thickness of a machine body, reduction in a size of the product and improvement in production efficiency. Also, a drain pipe added at a client end can also be omitted and there is no need to design a drainage system separately, which is conducive to reduction in installation costs of the product and improvement in installation efficiency. Meanwhile, the sealed box container also has a sound insulation effect to some extent, and this is conducive to reduction in operational noises of the product and improvement in user's comfort. In one embodiment, the sealed box container is further provided with the through hole in communication with the sealed cavity, and it is assured that the pipeline assembly in the sealed cavity can be coupled to the external pipeline via the through hole, to achieve normal circulation of the refrigerant. Moreover, it is designed to have box bodies, to assure that the pipeline assembly can be assembled into the sealed cavity, and the sealed cavity is relatively complete.

It could be understood that, the pipeline assembly includes but is not limited to components such as a refrigerant pipe, a valve and the like.

In addition, the sealed box container in the above embodiments provided by the present application may also have the following additional technical features:

In the above embodiments, two box bodies are provided. The number of the box bodies is two, and the number is relatively small, which is conducive to improvement in splicing efficiency of the sealed box container, reduction in the number of seams of the sealed box container, and improvement in sealing effect of the sealed cavity. Of course, the number of the box bodies may also be three, four, or more, and can be adjusted according to requirements in the actual production process.

In the above embodiments, the two box bodies are arranged in an up-and-down direction, and spliced to define the sealed cavity.

The two box bodies are arranged in the up-and-down direction and spliced to define the sealed cavity, and hence an upper box body is similar to a box cover. When assembly, a lower box body may be installed first, the pipeline assembly may be then installed, and finally the upper box body may be installed. In this way, the sight of a installation personnel is not easy to be blocked during installation, which facilitates the installation of the pipeline assembly, conforms to people's operating habits, and makes the installation process easy and fast.

In any of the above embodiments, the sealed box container includes a limiting structure, and the limiting structure is located in the sealed cavity to limit movement of the pipeline assembly.

In the related art, in order to support and fix the pipeline assembly in the main machine, support members need to be added. In order to avoid vibration and noises, portions in contact with the pipeline also need to employ components such as a rubber member or a sponge for shock absorption and noise reduction. Thus, there are numerous parts and components, the assembly is complicated, the production efficiency is low, the manufacturability is poor, it is prone to air leakage and sound leakage, and the reliability is greatly reduced. However, the sealed box container in the present solution is provided with the limiting structure, the limiting structure is located in the sealed cavity, and can limit the movement of the pipeline assembly, to have a fixing effect on the pipeline assembly. Thus, the support members for fixing the pipeline in the related art may be omitted. Meanwhile, the sealed box container itself has a sound insulation effect, the rubber member or the sponge for shock absorption and noise reduction may also be omitted. Therefore, parts and components of the main machine are significantly reduced, the assembly process is greatly simplified, the production efficiency is effectively improved, and the manufacturability and the reliability of the product are improved.

In the above embodiments, the limiting structure includes a protrusion, and the protraction is adapted to abut against the pipeline assembly; and/or the limiting structure includes a groove, and the groove is adapted to accommodate a portion of the pipeline assembly; and/or the limiting structure includes a cavity wall of the sealed cavity, and the cavity wall is adapted to abut against the pipeline assembly.

The limiting structure includes the protrusion, the protrusion can abut against the pipeline assembly at a distance from the cavity wall of the sealed cavity, to have a reliable support effect on this portion of pipeline assembly, and prevent random movement of the pipeline assembly. In some embodiments, the protrusion is arranged on a bottom wall and/or a top wall and/or a side wall of the sealed cavity, which can be reasonably arranged according to specific position of the pipeline assembly, to support the pipeline assembly at different positions.

The limiting structure includes the groove, and the groove can accommodate a portion of the pipeline assembly, to have a limit effect on the pipeline assembly, and to prevent random sway of the pipeline assembly. In some embodiments, the groove is defined in the cavity wall and/or the protrusion of the sealed cavity, and the shape and the size may be reasonably designed according to the pipeline assembly. For example: the groove has a circular arc form cross section, to match a cylindrical pipeline component; and the groove is an L-shaped extended strip groove, to match a corner portion of the refrigerant pipe.

The limiting structure includes the cavity wall of the sealed cavity, and the cavity wall can abut against the pipeline assembly at the cavity wall, to prevent displacement and deflection of the pipeline assembly.

In one embodiment, the limiting structure such as the protrusion, the groove, the cavity wall also has a positioning effect on the assembly of the pipeline assembly, to facilitate improvement of the assembly efficiency.

In any of the above embodiments, at least one of two adjacent box bodies is provided with a protruding part, and the other is correspondingly provided with a recessed part, the protruding part and the protruding part are located at a docketing position of the two adjacent box bodies, to cause the two adjacent box bodies to be concave-convex fitted.

The two adjacent box bodies are provided with the protruding part and the recessed part at the docketing position, respectively. When assembly, the two box bodies approach each other until the docketing is complete. In this case, the protruding part and the recessed part are concave-convex fitted. Compared to direct contact of two flat faces, the concave-convex fitted structure effectively increase the contact area of the two box bodes, increases a width of a seam between the two box bodies, and make the seam have a corner in the width direction, and the docketing position of the two box bodies form a stepped sealing structure, and the air can be prevented from passing through the seam, to improve the sealing of the two adjacent box bodies at the docketing position.

In the above embodiments, the protruding part includes a protruding edge, the recessed part includes a U-shaped groove having a U-shaped longitudinal section; and/or the protruding part includes a protruding edge, and the recessed part includes a step groove having an L-shaped longitudinal section.

The protruding part includes the protruding edge, the recessed part includes the U-shaped groove, and the protruding edge is inserted into the U-shaped groove. Thus, the seam also has a U shape in the width direction, and the sealing of the two adjacent box bodies at the docketing position can be effectively improved.

The protruding part includes the protruding edge, the recessed part includes the step groove, and the protruding edge just fills a step of the step groove. Thus, the seam also has an L shape in the width direction, and the sealing of the two adjacent box bodies at the docketing position can be effectively improved. Furthermore, each of end portions of the two adjacent box bodies is provided with a stepped structure, and the stepped structure forms the protruding edge and the step groove located at a side of the protruding edge. When the two stepped structures are fitted with each other, a dual concave-convex fitted structure can be formed. That is, the protruding edge of one box body is inserted into the step groove of the other box body, and meanwhile, the step groove of the one box body is inserted by the protruding edge of the other box body. In this case, the seam has a substantially Z shape in the width direction, and the sealing of the two adjacent box bodies at the docketing position can be effectively improved. Of course, the protruding part may have a hemispherical shape, a cylindrical shape, a conical shape, or other structures.

In any of the above embodiments, the through hole has a cross sectional area gradually increasing from inside to outside, and the through hole is provided with a sealing ring.

The cross sectional area of the through hole gradually increases from inside to outside, to facilitate coupling of the pipeline assembly in the sealed cavity and the external pipeline structure. The through hole is provided with the sealing ring, and the through hole can be sealed, to further improve the sealing of the sealed cavity.

In the above embodiments, the sealing ring defines a sealing groove, the box body is provided with a sealing rib, and the sealing rib is embedded in the sealing groove.

The sealing ring defines the sealing groove, the box body is provided with the sealing rib, and the sealing rib is embedded in the sealing groove, to improve stability and use reliability of the sealing ring. In some embodiments, the sealing rib may be the protruding edge in the above embodiments.

In any of the above embodiments, the through hole is formed by splicing adjacent box bodies.

The through hole is formed by splicing adjacent box bodies, and the shape of the box body can be reasonably set to omit the machining process of the through hole and improve the production efficiency. In some embodiments, each box body defines a half hole, and corresponding half holes of two box bodies are spliced to form a complete through hole.

In any of the above embodiments, the sealed box container is a foamed member.

The sealed box container is the foamed member. The form has excellent sealing performance, shock absorption performance, and sound insulation performance, and can be easily processed into various desired shapes according to requirements, machining technology is mature and cost-effective, and it has light mass and is suitable for promotion. Of course, the sealed box container may also be other materials such as a rubber member, a silicone member and the like.

The embodiments of a second aspect of the present application provide a main machine for a heat recovery switching device, including: a sealed box container as described in any of the embodiments of the first aspect; a housing fitted over an outside of the sealed box container and defines a coupling hole in corresponding communication with the through hole of the sealed box container; and a pipeline assembly arranged in the sealed cavity of the sealed box container.

The main machine provided by the embodiments of the second aspect of the present application includes the sealed box container in any of the embodiments of the first aspect, and hence has all the beneficial effects of any of the above embodiments, which are not repeated herein.

The embodiments of a third aspect of the present application provide a heat recovery switching device, including: a main machine as described in the embodiments of the second aspect; and an electric control box coupled to the main machine.

The heat recovery switching device provided by the embodiments of the third aspect of the present application includes the main machine in any of the embodiments of the first aspect, and hence has all the beneficial effects of any of the above embodiments, which are not repeated herein.

In the above embodiments, a side wall of the electric control box defines a wire storage space configured to store a wire.

The side wall of the electric control box defines the wire storage space, to facilitate storage of the wire.

Embodiments of a fourth aspect of the present application provide a refrigeration device, including a heat recovery switching device according to the embodiments of the second aspect, the heat recovery switching device including a main machine according to embodiments of the second aspect; an indoor unit coupled to an indoor interface of the heat recovery switching device; and an outdoor unit coupled to an outdoor unit interface of the heat recovery switching device.

The refrigeration device provided by the embodiments of the fourth aspect of the present application includes the main machine in any of the embodiments of the second aspect, and hence has all the beneficial effects of any of the above embodiments, which are not repeated herein.

Additional embodiments of the present application will become apparent in part from the following descriptions, or be learned from the practice of the present application.

BRIEF DESCRIPTION OF THE DRAWINGS

These and other embodiments of the present application will become apparent and more readily appreciated from the following descriptions made with reference to the drawings, in which.

These and embodiments of the present application will become apparent and more readily appreciated from the following descriptions made with reference to the drawings, in which.

Figure 1:
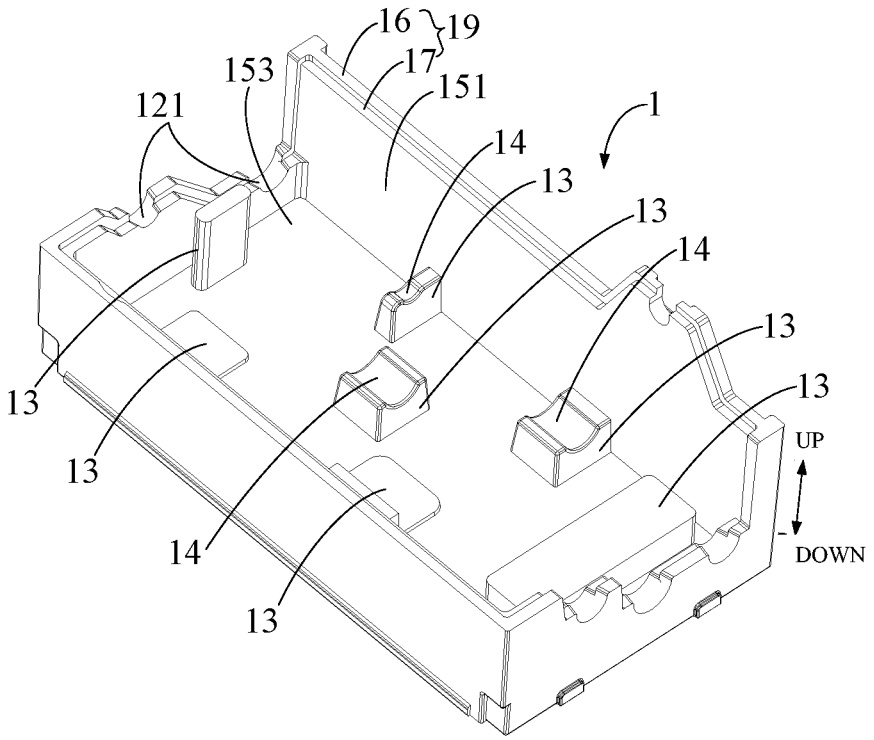
FIG. 1 is a perspective view of a box body according to some embodiments of the present application.
Figure 2:
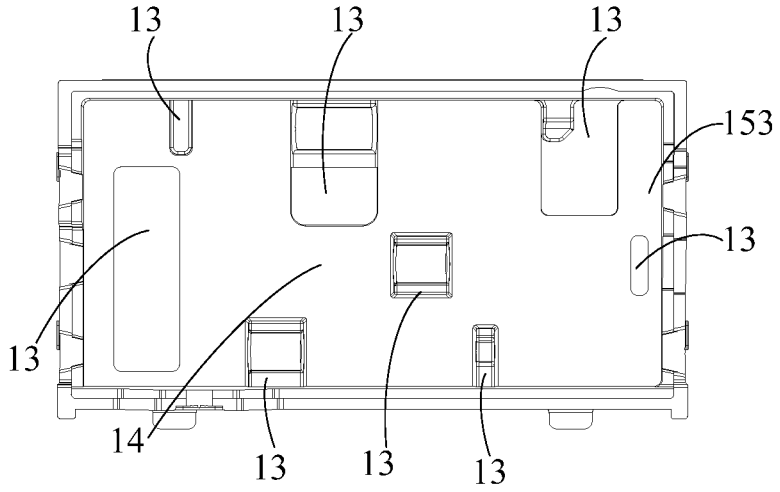
FIG. 2 is a top view of the box body illustrated in FIG. 1.

In which, correspondence between reference numerals in FIGS. 1 to 14 and component names is as follows:

100 sealed box container, 1 box body, 11 sealed cavity, 12 through hole, 121 half hole, 13 protrusion, 14 groove, 151 side wall, 152 top wall, 153 bottom wall, 16 protruding part, 17 recessed part, 18 sealing rib, 19 stepped structure, 2 sealing ring, 21 sealing groove, 200 main machine, 202 housing, 204 pipeline assembly, 300 heat recovery switching device, 302 electric control box, 304 wire storage space, 400 refrigeration device, 402 indoor unit, 404 outdoor unit.

DETAILED DESCRIPTION OF THE DISCLOSURE

In order to more clearly understand the above-described embodiments of the present application, the present application will be further described in detail with reference to the accompanying drawings and embodiments. It should be noted that the embodiments in the present application and the features in the embodiments may be combined with each other without conflict.

Embodiments are elaborated in the following description to facilitate adequate understanding of the present application. However, the present application may also be implemented by using other ways different what is described herein. Therefore, the scope of the present application is not limited by the embodiments disclosed below.

A sealed box container, a main machine, a heat recovery switching device and a refrigeration device according to some embodiments of the present application will be described below with reference to FIGS. 1 to 14.

Embodiments of a first aspect of the present application provide a sealed box container 100 adapted to be arranged in a main machine 200 of a heat recovery switching device 300, and the sealed box container 100 includes box bodies 1, as illustrated in FIGS. 1 to 5.

Figure 8:
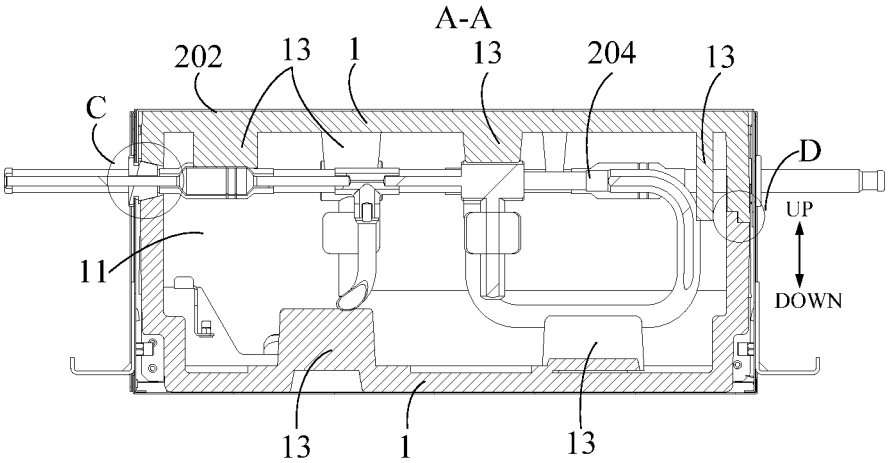
FIG. 8 is a sectional view taken along A-A in FIG. 7.
Figure 9:
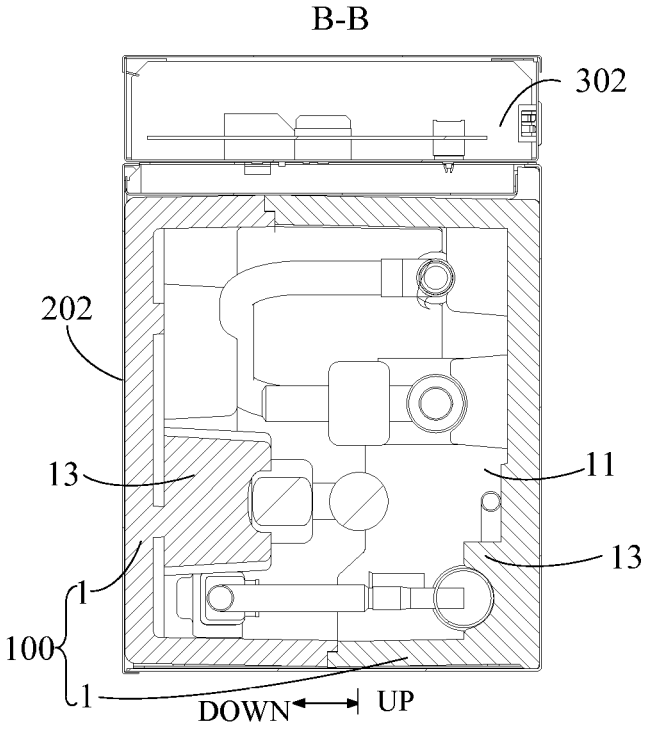
FIG. 9 is a sectional view taken along B-B in FIG. 7.
Figure 10:
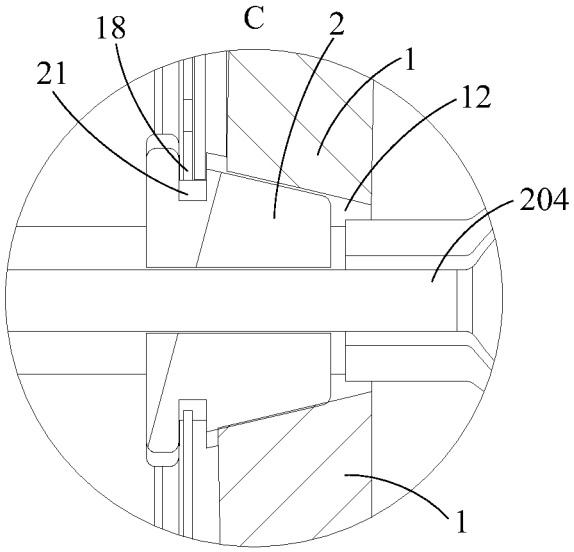
FIG. 10 is an enlarged view of portion C in FIG. 8.

In some embodiments, box bodies 1 are spliced to define a sealed cavity 11, as illustrated in FIG. 8, and is provided with a through hole 12 in communication with the sealed cavity 11, as illustrated in FIG. 10. The sealed cavity 11 is used for accommodating a pipeline assembly 204 of the main machine 200, and as illustrated in FIGS. 8 and 9, the pipeline assembly 204 is connected to an external pipeline by means of the through hole 12.

The sealed box container 100 provided by the embodiments of the first aspect of the present application includes box bodies 1, box bodies 1 can be spliced to define a sealed cavity 11, and when the sealed box container 100 is assembled in a main machine 200, the pipeline assembly 204 of the main machine 200 can be accommodated in the sealed cavity 11, to block free exchange of the air inside the main machine 200 with the outside air. Thus, generation of condensation can be effectively prevented, and generation of condensed water in the main machine 200 can be avoided.

This is conducive to improvement of heat recovery efficiency and conforms to requirements for energy saving and environmental protection. Furthermore, a water tray and an added sponge in a main machine 200 of the related art can be omitted, and this is conducive to reduction in thickness of a machine body, reduction in a size of the product and improvement in production efficiency. Also, a drain pipe added at a client end can be omitted and there is no need to design a drainage system separately, which is conducive to reduction in installation costs of the product and improvement in installation efficiency.

Meanwhile, the sealed box container 100 also has a sound insulation effect to some extent, and this is conducive to reduction in operational noises of the product and improvement in user's comfort.

In one embodiment, the sealed box container 100 is further provided with the through hole 12 in communication with the sealed cavity 11, and it is assured that the pipeline assembly 204 in the sealed cavity 11 can be coupled to the external pipeline via the through hole 12, to achieve normal circulation of the refrigerant. Moreover, it is designed to have box bodies 1, to assure that the pipeline assembly 204 can be assembled into the sealed cavity 11, and the sealed cavity 11 is relatively complete.

It could be understood that, the pipeline assembly 204 includes but is not limited to components such as a refrigerant pipe, a valve and the like.

In some embodiments of the present application, two box bodes 1 are provided, as illustrated in FIGS. 8 and 9.

The number of the box bodies 1 is two, and the number is relatively small, which is conducive to improvement in splicing efficiency of the sealed box container 100, reduction in the number of seams of the sealed box container 100, and improvement in sealing effect of the sealed cavity 11.

Of course, the number of the box bodies 1 may also be three, four, or more, and can be adjusted according to requirements in the actual production process.

In an embodiment of the present application, the two box bodies 1 are arranged in an up-and-down direction, as illustrated in FIGS. 8 and 9, and are spliced to define the sealed cavity 11.

Figure 6:
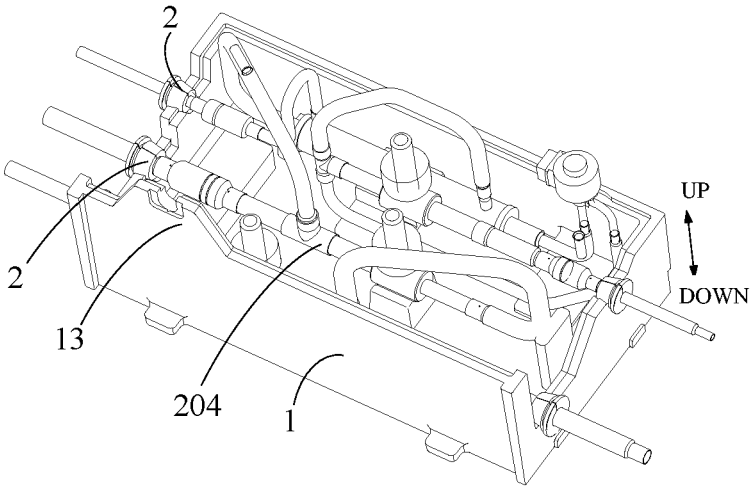
FIG. 6 is a partial schematic diagram of a main machine according to some embodiments of the present application.

The two box bodies 1 are arranged in the up-and-down direction and spliced to define the sealed cavity 11, and hence an upper box body 1 is similar to a box cover. When assembly, a lower box body 1 may be installed first, the pipeline assembly 204 may be then installed as illustrated in FIG. 6, and finally the upper box body 1 may be installed. In this way, the sight of a installation personnel is not easy to be blocked during installation, which facilitates the installation of the pipeline assembly 204, conforms to people's operating habits, and makes the installation process easy and fast.

In some embodiments of the present application, the sealed box container 100 further includes a limiting structure, and the limiting structure is located in the sealed cavity 11 to limit movement of the pipeline assembly 204.

In the related art, in order to support and fix the pipeline assembly 204 in the main machine 200, support members need to be added. In order to avoid vibration and noises, portions in contact with the pipeline also need to employ components such as a rubber member or a sponge for shock absorption and noise reduction. Thus, there are numerous parts and components, the assembly is complicated, the production efficiency is low, the manufacturability is poor, it is prone to air leakage and sound leakage, and the reliability is greatly reduced.

However, the sealed box container 100 in the present solution is provided with the limiting structure, and the limiting structure is located in the sealed cavity 11, and the movement of the pipeline assembly 204 can be limited to have a fixing effect on the pipeline assembly 204. Thus, the support members for fixing the pipeline in the related art may be omitted. Meanwhile, the sealed box container 100 itself has a sound insulation effect, the rubber member or the sponge for shock absorption and noise reduction may also be omitted. Therefore, parts and components of the main machine 200 are significantly reduced, the assembly process is greatly simplified, the production efficiency is effectively improved, and the manufacturability and the reliability of the product are improved.

In some embodiments, the limiting structure includes a protrusion 13, as illustrated in FIGS. 1, 2, 4 and 5. The protrusion 13 is adapted to abut against the pipeline assembly 204, as illustrated in FIGS. 8 and 9.

The limiting structure includes the protrusion 13, the protrusion 13 can abut against the pipeline assembly 204 at a distance from the cavity wall of the sealed cavity 11, to have a reliable support effect on this portion of pipeline assembly 204, and prevent random movement of the pipeline assembly 204.

In some embodiments, the protrusion 1 is arranged on a bottom wall 153 and/or a top wall 152 and/or a side wall 151 of the sealed cavity 11, which can be reasonably arranged according to specific position of the pipeline assembly 204, to support the pipeline assembly 204 at different positions. The shape and size of the protrusion 13 can be reasonably designed according to the structure and layout of the pipeline assembly 204, and for example it may have a flat-plate shape, a folded plate shape, a columnar shape, a strip shape or the like.

Figure 4:
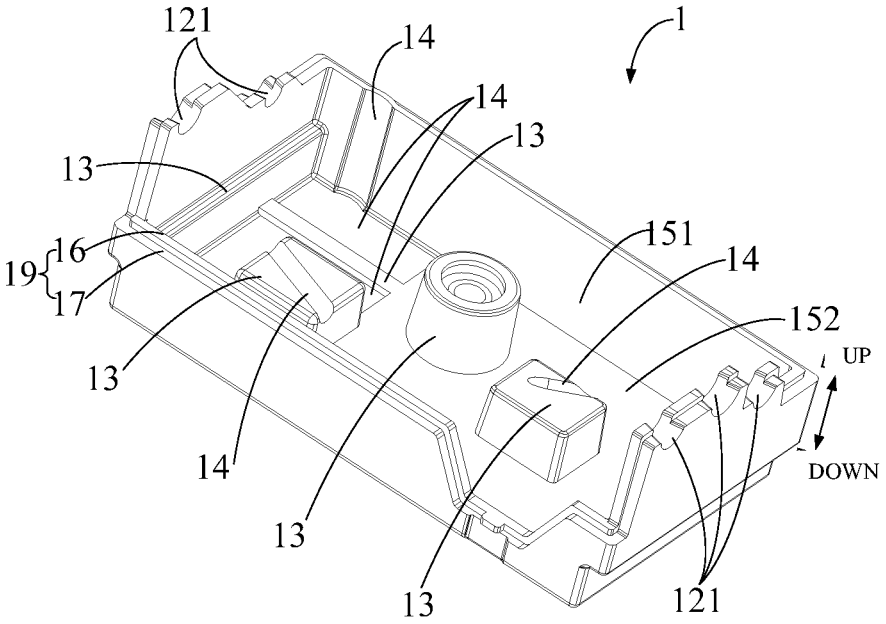
FIG. 4 is a perspective view of another box body according to some embodiments of the present application.
Figure 5:
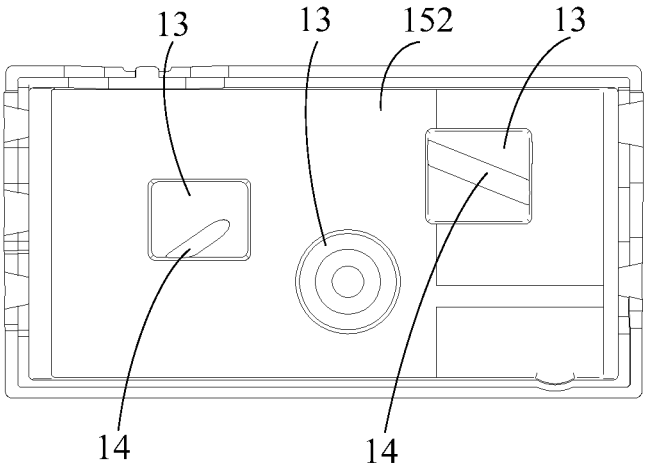
FIG. 5 is a top view of the box body illustrated in FIG. 4.

Further, the limiting structure includes a groove 14, as illustrated in FIGS. 1 and 4. The groove 14 is adapted to accommodate a portion of the pipeline assembly 204.

The limiting structure includes the groove 14, and the groove 14 can accommodate a portion of the pipeline assembly 204, to have a limit effect on the pipeline assembly 204, and to prevent random sway of the pipeline assembly 204.

In some embodiments, the groove 14 is defined in the cavity wall and/or the protrusion 13 of the sealed cavity 11, and the shape and the size may be reasonably designed according to the pipeline assembly 204.

For example: the groove 14 has a circular arc form cross section, to match a cylindrical pipeline component; and the groove 14 is an L-shaped extended strip groove, to match a corner portion of the refrigerant pipe.

Further, the limiting structure includes a cavity wall of the sealed cavity 11, and the cavity wall is adapted to abut against the pipeline assembly 204.

The limiting structure includes the cavity wall of the sealed cavity 11, and the cavity wall can abut against the pipeline assembly 204 at the cavity wall, to prevent displacement and deflection of the pipeline assembly 204. The cavity wall includes a top wall 152, a bottom wall 153 and a side wall 151.

In one embodiment, the limiting structure such as the protrusion 13, the groove 14, and the cavity wall also has a positioning effect on the assembly of the pipeline assembly 204, to facilitate improvement of the assembly efficiency.

Figure 11:
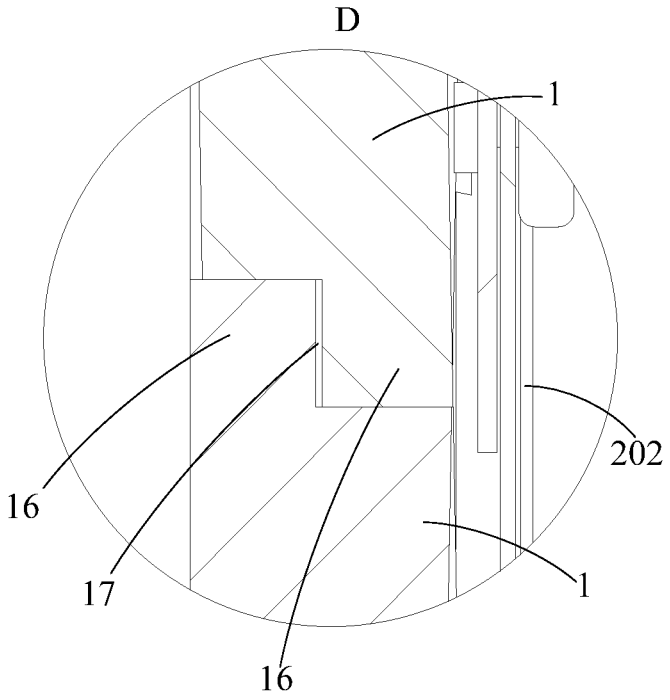
FIG. 11 is an enlarged view of portion D in FIG. 8.
Figure 12:
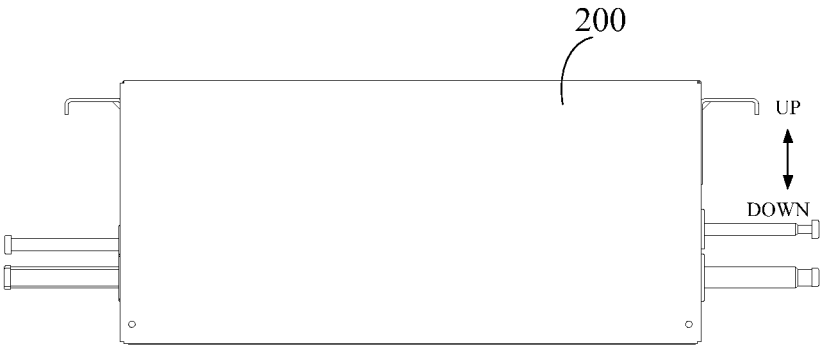
FIG. 12 is a front view of the heat recovery switching device illustrated in FIG. 7.
Figure 13:
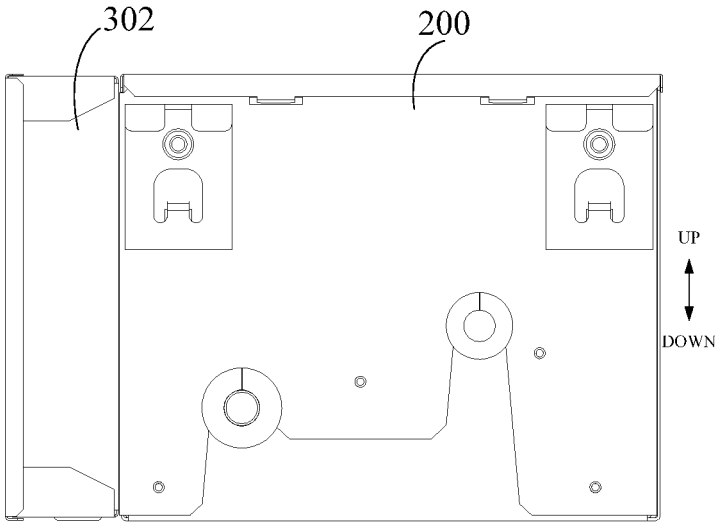
FIG. 13 is a left view of the heat recovery switching device illustrated in FIG. 7.

In some embodiments of the present application, further, at least one of two adjacent box bodies 1 is provided with a protruding part 16, as illustrated in FIGS. 1 and 4, and the other is correspondingly provided with a recessed part 17. The protruding part 16 and the protruding part 16 are located at a docketing position of the two adjacent box bodes 1, to cause the two adjacent box bodies 1 to be concave-convex fitted, as illustrated in FIG. 11.

The two adjacent box bodies 1 are provided with the protruding part 16 and the recessed part 17 at the docketing position, respectively. When assembly, the two box bodies 1 approach each other until the docketing is complete. In this case, the protruding part 16 and the recessed part 17 are concave-convex fitted. Compared to direct contact of two flat faces, the concave-convex fitted structure effectively increases the contact area of the two box bodes 1, increases a width of a seam between the two box bodies 1, and makes the seam have a corner in the width direction, and the docketing position of the two box bodies 1 form a stepped sealing structure, and the air can be prevented from passing through the seam, to improve the sealing of the two adjacent box bodies 1 at the docketing position.

In an embodiment of the present application, the protruding part 16 includes a protruding edge, the recessed part 17 includes a step groove, and the step groove has an L-shaped longitudinal section, as illustrated in FIGS. 1 and 4.

The protruding part 16 includes a protruding edge, the recessed part 17 includes a step groove, and the protruding edge just fills at a step of the step groove, and the seam also has an L shape in the width direction, and thus the sealing of the two adjacent box bodies 1 at the docketing position can be improved.

Further, each of end portions of the two adjacent box bodies 1 is provided with a stepped structure 19, as illustrated in FIGS. 1 and 4. The stepped structure 19 defines a protruding edge and a step groove located at a side of the protruding edge, and when the two stepped structures 19 are fitted with each other, a dual concave-convex fitted structure may be formed. That is, the protruding edge of one box body 1 is inserted into the step groove of the other box body 1, and meanwhile, the step groove of the one box body 1 is inserted by the protruding edge of the other box body 1, as illustrated in FIG. 11. In this case, the seam has a substantially Z shape in the width direction, and thus the sealing of the two adjacent box bodies 1 at the docketing position can be improved.

Of course, the protruding part 16 may also have a hemispherical shape, a cylindrical shape, a conical shape, or other structures.

In an embodiment of the present application (not illustrated in the figures), the protruding part 16 includes the protruding edge, the recessed part 17 include a U-shaped groove, and the U-shaped groove has a U-shaped longitudinal section.

The protruding part 16 includes the protruding edge, the recessed part 17 includes the U-shaped groove, and the protruding edge is inserted into the U-shaped groove, and the seam also has a U shape in the width direction, and thus the sealing of the two adjacent box bodies 1 at the docketing position can be improved.

In some embodiments of the present application, the through hole 12 has a cross-sectional area increasing gradually from inside to outside, as illustrated in FIG. 10. The through hole 12 is provided with a sealing ring 2.

The cross-sectional area of the through hole 12 gradually increases from inside to outside, to facilitate coupling of the pipeline assembly 204 in the sealed cavity 11 and the external pipeline structure. The sealing ring 2 is arranged at the through hole 12, and the through hole 12 can be sealed, to further improve the sealing of the sealed cavity 11. The term "from inside to outside" refers to a direction pointing from an inside of the sealed cavity 11 to an outside of a sealed box.

Further, the sealing ring 2 defines a sealing groove 21, and the box body 1 is provided with a sealing rib 18, as illustrated in FIG. 10. The sealing rib 18 is embedded in the sealing groove 21.

The sealing ring 2 defines the sealing groove 21, the box body 1 is provided with the sealing rib 18, and the sealing rib 18 is embedded in the sealing groove 21, to improve the stability and use reliability of the sealing ring 2.

In some embodiments, the sealing rib 18 may be the protruding edge in the above embodiments.

In some embodiments of the present application, the through hole 12 is formed by splicing adjacent box bodies 1, as illustrated in FIG. 10.

The through hole 12 is formed by splicing adjacent box bodies 1, and the shape of the box body 1 can be reasonably designed, to omit machining process of the through hole 12, and improve production efficiency.

Figure 3:
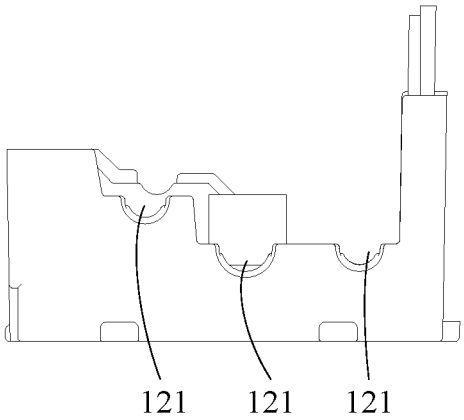
FIG. 3 is a front view of the box body illustrated in FIG. 1.

In some embodiments, each box body 1 defines a half hole 121, as illustrated in FIGS. 1, 3 and 4, and corresponding half holes 121 of the two box bodies 1 are spliced to define a complete through hole 12.

In some embodiments of the present application, the sealed box container 100 is a foamed member.

The sealed box container 100 is the foamed member, The form has excellent sealing performance, shock absorption performance, and sound insulation performance, and can be easily processed into various desired shapes according to requirements, machining technology is mature and cost-effective, and it has light mass and is suitable for promotion.

Of course, the sealed box container 100 may also be other materials such as a rubber member, a silicone member and the like.

As illustrated in FIG. 6, a main machine 200 for a heat recovery switching device 300 provided by embodiments of a second aspect of the present application includes a sealed box container 100 as stated in any of the embodiments of the first aspect, a housing 202 and a pipeline assembly 204.

In some embodiments, the housing 202 is fitted over an outside of the sealed box container 100, as illustrated in FIGS. 8 and 9, and defines a coupling hole in corresponding communication with the through hole 12 of the sealed box container 100.

The pipeline assembly 204 is arranged in the sealed cavity 11 in the sealed box container 100, as illustrated in FIGS. 8 and 9.

The main machine 200 provided by the embodiments of the second aspect of the present application includes the sealed box container 100 in any of the embodiments of the first aspect, and hence has all the beneficial effects of any of the above embodiments, which are not repeated herein.

As illustrated in FIGS. 7, 8, 9, 12 and 13, a heat recovery switching device 300 provided by embodiments of a third aspect of the present application includes a main machine 200 in the embodiments of the second aspect and an electric control box 302.

The electric control box 302 is coupled to the main machine 200. In some embodiments, a box body of the electric control box 302 is coupled to a rear side wall of the main machine 200, an electric control device is stored in the electric control box 302, and the electric control device is electrically coupled to an electrical element in the main machine 200.

The heat recovery switching device 300 provided by the embodiments of the third aspect of the present application includes the main machine 200 in any of the embodiments of the first aspect, and hence has all the beneficial effects of any of the above embodiments, which are not repeated herein.

In some embodiments, the housing 202 is a sheet metal member and has a protective effect on the sealed box container 100, to prevent fracture of the sealed box container 100.

Figure 7:
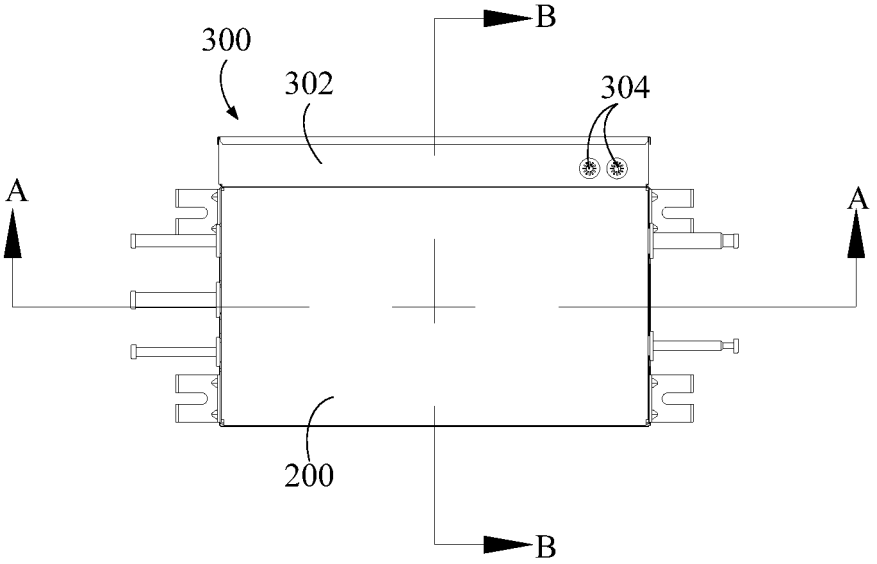
FIG. 7 is a top view of a heat recovery switching device according to some embodiments of the present application.

In an embodiment of the present application, the side wall of the electric control box 302 defines a wire storage space 304 for storing a wire, as illustrated in FIG. 7.

The side wall of the electric control box 302 defines the wire storage space 304, to facilitate storage of the wire.

Figure 14:
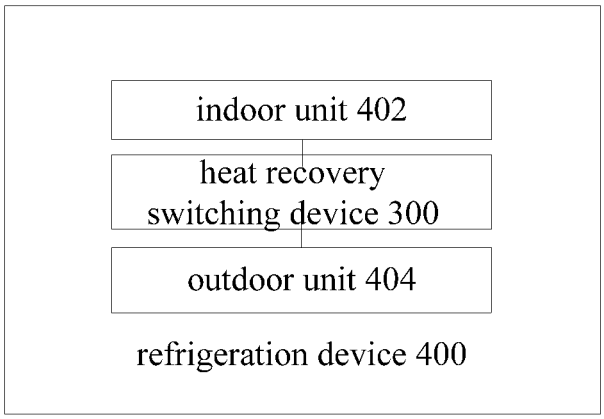
FIG. 14 is a schematic block diagram of a refrigeration device according to some embodiments of the present application.

As illustrated in FIG. 14, a refrigeration device 400 provided by embodiments of a fourth aspect of the present application includes a heat recovery switching device 300 in the embodiments of the third aspect, an indoor unit 402 and an outdoor unit 404.

In some embodiments, the indoor unit 402 is coupled to an indoor unit 402 interface of the heat recovery switching device 300.

The outdoor unit 404 is coupled to an outdoor unit 404 interface of the heat recovery switching device 300.

The refrigeration device 400 provided by the embodiments of the fourth aspect of the present application include the heat recovery switching device 300 in any of the embodiments of the first aspect, and hence has all the beneficial effects of any of the above embodiments, which are not repeated herein.

One embodiment is introduced below and compared to the related art.

A common heat recovery switching device 300 employs a separate water tray to collect and drain the condensed water. Meanwhile, in order to support and fix internal pipeline components, support members need to be added to fix the pipeline. In order to avoid vibration and noises, portions in contact with the pipeline also need to employ a rubber member or a sponge for shock absorption and noise reduction. Meanwhile, in order to reduce the condensation, sponge needs to be adhered inside the machine body to prevent condensation. Thus, there are often numerous parts and components, the assembly is complicated, the production efficiency is low, the manufacturability is poor, it is prone to air leakage and sound leakage, and the reliability is greatly reduced. Added water tray and sponge increase a thickness of the machine body, and increases the costs. A drain pipe needs to be added at the client end, and a drainage system needs to be designed separately, increasing installation costs of the client and seriously affecting the installation efficiency of the client. At the same time, the condensed water also reduces the heat recovery efficiency, which is not conducive to energy saving and environmental protection.

The present example employs a structural form that fully seals and supports the pipeline. The upper and lower layers of foam having sealing structure (i.e., upper and lower box bodies 1) are employed at the pipeline portion. The protrusion 13 structure is present inside the upper and lower foam, to support and fix the pipeline portion. The sealed foam isolates air exchange between the heat recovery switching device 300 of the refrigeration device 400 and the outside, to prevent condensation on the pipeline, and at the same time to fix the pipeline and have an effect of noise and vibration prevention. This solution has a simple structure, high manufacturing and production efficiency, good reliability, low costs; facilities installation of the client; and significantly reduces the thickness of the machine body, meeting the installation requirements within a small space of the client.

Further, a periphery of the upper and lower layers of foam employs a stacked sealing design, i.e., the stepped sealing; and the nozzle portion employs a sealing design of a chamfer and an external sealing rubber, the generation of the condensed water is reduced, the space occupation and production costs of the water tray is saved, and stable coupling is achieved.

Further, the side wall structure inside the upper and lower layers of foam can reduce displacement and deflection of the pipeline, and assure overall sealing of a refrigerant distributor (i.e., the main machine 200).

Further, the side wall of the electric control box 302 leaves a space for accommodating the wire.

In some embodiments, a heat recovery switching device 300, includes a main machine 200 and an electric control box 302. The main machine 200 is coupled to the indoor unit 402 and the outdoor unit 404 separately. The electric control box 302 includes a box body and an electric control device stored in the box body, the box body is arranged at a side of the main machine 200, and the electric control device is electrically coupled to the main machine 200.

The periphery of the main machine 200 is a sheet metal structure, the lower foam structure (i.e., the box body 1 located at a lower side) is on a baseplate, various supports for the pipeline, support structures for the valve and side wall structure for positioning are in the foam. Left and right side plates are snapped into the baseplate, and fixed by screws. The upper foam (i.e., the box body 1 located at an upper side) is assembled to the lower foam. Piping are performed between outer peripheral wall and the outer wall through step faces, to enhance sealing effect. The upper foam also has a structure that holds down the pipeline and the valve, which encloses the internal pipeline member and the valve in a sealed space together with the lower foam. In and out pipeline members are fitted with rubber rings, two ends of the upper and lower foams are tightly fitted with the sealing rings 2 on in and out pipes of the pipeline member, the side wall of the electric control box 302 of the heat recovery switching device 300 has a space structure for storing the wire.

In conclusion, the sealed box container provided by the present application includes box bodies, box bodies can be spliced to define a sealed cavity, and when the sealed box container is assembled in a main machine, the pipeline assembly of the main machine can be accommodated in the sealed cavity, to block free exchange of the air inside the main machine with the outside air. Thus, condensation can be effectively prevented to avoid generation of condensed water in the main machine. This is conducive to improvement of heat recovery efficiency and conforms to requirements for energy saving and environmental protection. Furthermore, a water tray and an added sponge in a main machine of the related art can be omitted, and this is conducive to reduction in thickness of a machine body, reduction in a size of the product and improvement in production efficiency. Also, a drain pipe added at a client end can be omitted and there is no need to design a drainage system separately, which is conducive to reduction in installation costs of the product and improvement in installation efficiency. Meanwhile, the sealed box container also has a sound insulation effect to some extent, and this is conducive to reduction in operational noises of the product and improvement in user's comfort. In one embodiment, the sealed box container is further provided with the through hole in communication with the sealed cavity, and it is assured that the pipeline assembly in the sealed cavity can be coupled to the external pipeline via the through hole, to achieve normal circulation of the refrigerant. Moreover, it is designed to have box bodies, to assure that the pipeline assembly can be assembled into the sealed cavity, and the sealed cavity is relatively complete.

In the present application, terms such as "first" "second" and "third" are used herein for purposes of description and are not intended to indicate or imply relative importance or significance. The term "plurality of" means two or more, unless otherwise expressly specified. The terms "mounted," "connected," "coupled," "fixed" and the like are used broadly. For example, "connected" may be fixed connections, detachable connections, or integral connections; "coupled" may also be direct connections or indirect connections via intervening structures.

In the description of the present application, it should be understood that, terms such as "upper", "lower", "left", "right", "front" and "rear" as well as derivative thereof should be construed to refer to the orientation as then described or as shown in the drawings under discussion. These relative terms are for convenience of description and do not indicate or suggest that the device or unit referred to must be constructed or operated in a particular orientation. Thus, they cannot be construed to limitation of the present application.

In the description of this specification, the terms "an embodiment," "some embodiments," or "a specific example," mean that a particular feature, structure, material, or characteristic described in connection with the embodiment or example is included in at least one embodiment or example of the present application. In the present specification, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A sealed box container within a main machine for a heat recovery switching device, the sealed box container comprising:

a plurality of box bodies spliced to define a sealed cavity and provided with a through hole in communication with the sealed cavity, the sealed cavity being configured to accommodate a pipeline assembly of the main machine, and the pipeline assembly being coupled to an external pipeline via the through hole;

wherein a diameter of the through hole gradually increases along direction of inside of the sealed cavity to outside of the sealed cavity, and the through hole is provided with a sealing ring.

2. The sealed box container according to claim 1, wherein two box bodies are provided.

3. The sealed box container according to claim 2, wherein the two box bodies are arranged in an up-and-down direction, and spliced to define the sealed cavity.

4. The sealed box container according to claim 1, wherein the sealed box container comprises a limiting structure located in the sealed cavity to limit movement of the pipeline assembly.

5. The sealed box container according to claim 4, wherein the limiting structure comprises a protrusion adapted to abut against the pipeline assembly; and/or the limiting structure comprises a groove adapted to accommodate a portion of the pipeline assembly; and/or the limiting structure comprises a cavity wall of the sealed cavity adapted to abut against the pipeline assembly.

6. The sealed box container according to claim 1, wherein at least one of two adjacent box bodies are provided with a protruding part, and the other one is correspondingly provided with a recessed part, the protruding part and the recessed part are located at a docketing position of the two adjacent box bodies, to cause the two adjacent box bodies to be concave-convex fitted.

7. The sealed box container according to claim 6, wherein the protruding part comprises a protruding edge, the recessed part comprises a U-shaped groove having a U-shaped longitudinal section; and/or the protruding part comprises a protruding edge, and the recessed part comprises a step groove having an L-shaped longitudinal section.

8. The sealed box container according to claim 1, wherein the sealing ring defines a sealing groove, a body of the box is provided with a sealing rib, and the sealing rib is embedded in the sealing groove.

9. The sealed box container according to claim 1, wherein the through hole is formed by splicing adjacent box bodies.

10. The sealed box container according to claim 1, wherein the sealed box container is a foamed member.

11. A main machine for a heat recovery switching device, comprising:

a sealed box container, comprising:

a plurality of box bodies spliced to define a sealed cavity and provided with a through hole in communication with the sealed cavity, the sealed cavity being configured to accommodate a pipeline assembly of the main machine, and the pipeline assembly being coupled to an external pipeline via the through hole; and a housing fitted over an outside of the sealed box container and defining a coupling hole in corresponding communication with the through hole of the sealed box container;

wherein a diameter of the through hole gradually increases along direction of inside of the sealed cavity to outside of the sealed cavity, and the through hole is provided with a sealing ring.

12. A refrigerating device, comprising:

a heat recovery switching device comprising a main machine, the main machine comprising:

a sealed box container, comprising:

a plurality of box bodies spliced to define a sealed cavity and provided with a through hole in communication with the sealed cavity, the sealed cavity being configured to accommodate a pipeline assembly of the main machine, and the pipeline assembly being coupled to an external pipeline via the through hole; and a housing fitted over an outside of the sealed box container and defining a coupling hole in corresponding communication with the through hole of the sealed box container;

an indoor unit coupled to an indoor unit interface of the heat recovery switching device; and an outdoor unit coupled to an outdoor unit interface of the heat recovery switching device;

wherein a diameter of the through hole gradually increases along direction of inside of the sealed cavity to outside of the sealed cavity, and the through hole is provided with a sealing ring.

* * * * *